US006237181B1

(12) United States Patent
Onuffer

(10) Patent No.: US 6,237,181 B1
(45) Date of Patent: May 29, 2001

(54) COMB FOR REMOVING DEBRIS ON CARPET

(76) Inventor: Dawn L. Onuffer, 178 Mallet Bayou Rd., Freeport, FL (US) 32439

( * ) Notice: Subject to any disclaimer, the term of this patent is extended or adjusted under 35 U.S.C. 154(b) by 0 days.

(21) Appl. No.: 09/487,461

(22) Filed: Jan. 19, 2000

(51) Int. Cl.[7] ..... A47L 13/02

(52) U.S. Cl. ..... 15/142; 15/236.06; 15/236.08; 30/172

(58) Field of Search ..... 15/142, 236.08, 15/236.06; 30/172, 503, 503.5, 507

(56) References Cited

U.S. PATENT DOCUMENTS

| | | | | |
|---|---|---|---|---|
| 553,300 | * | 1/1896 | Carden | 15/142 |
| 854,725 | * | 5/1907 | Devers | 15/236.08 |
| 1,008,382 | * | 11/1911 | Sourek | 15/142 |
| 6,023,811 | * | 2/2000 | Ciarrocchi | 15/236.08 |

FOREIGN PATENT DOCUMENTS

| | | | | |
|---|---|---|---|---|
| 804859 | * | 4/1951 | (DE) | 15/236.08 |

* cited by examiner

*Primary Examiner*—Randall E. Chin

(57) ABSTRACT

The present invention "A Comb for Removing Debris on Carpet" is a hand held tool that will comb debris such as pine needles or other debris left lying on carpet or embedded in carpet into a pile for easy pick-up. This tool consists of a body, a handle, and a plurality of plates that are spaced, varying in height, and extended the entire length of the body. These plates extend upward into parallel grooves cut into the underside of the body and are permanently attached there. These plates also extend downward from the body and have a plurality of teen that are distal from the body deposed on the edge of each plate. The teeth are in a saw-toothed configuration. The tool is held in the hand(s) and is drawn towards the operator. The plates and teeth are in contact with the carpet. The manual action of drawings the tool over the carpet results in the collection of debris at the front side of the tool and between the plates. Repeating this action results in having a pile of debris that can be picked up manually or swept into a dust pan.

1 Claim, 4 Drawing Sheets

FIG. 3
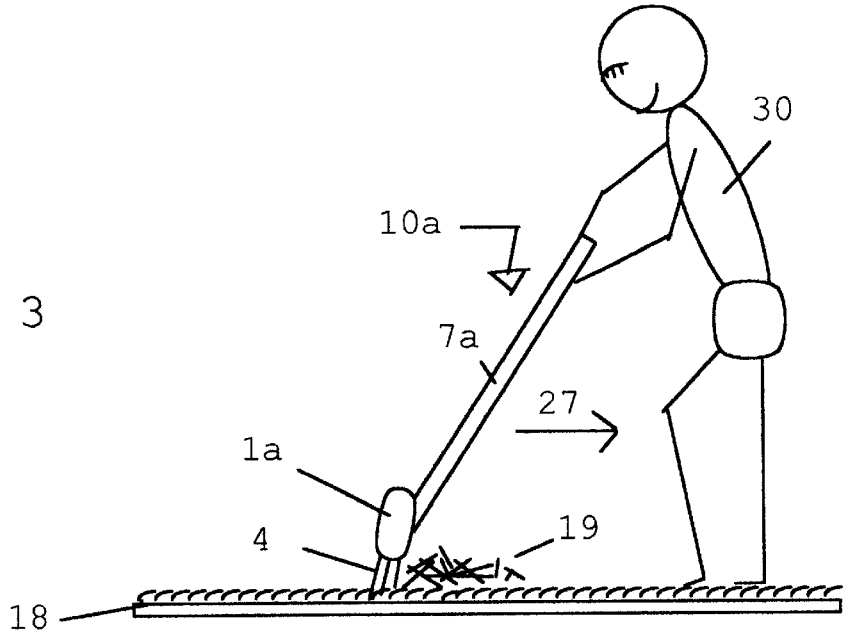
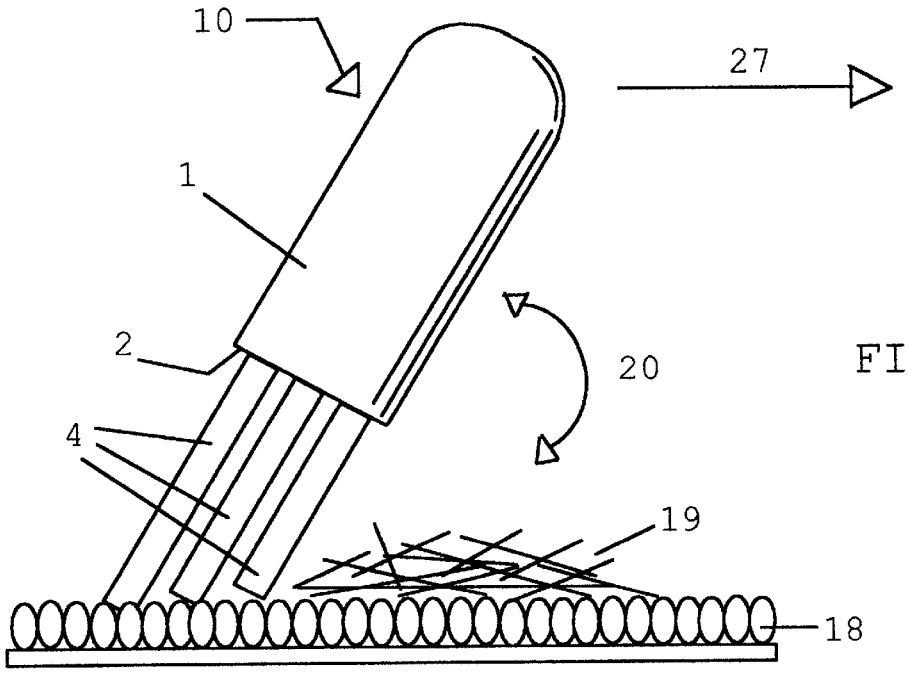
FIG. 4

FIG. 5
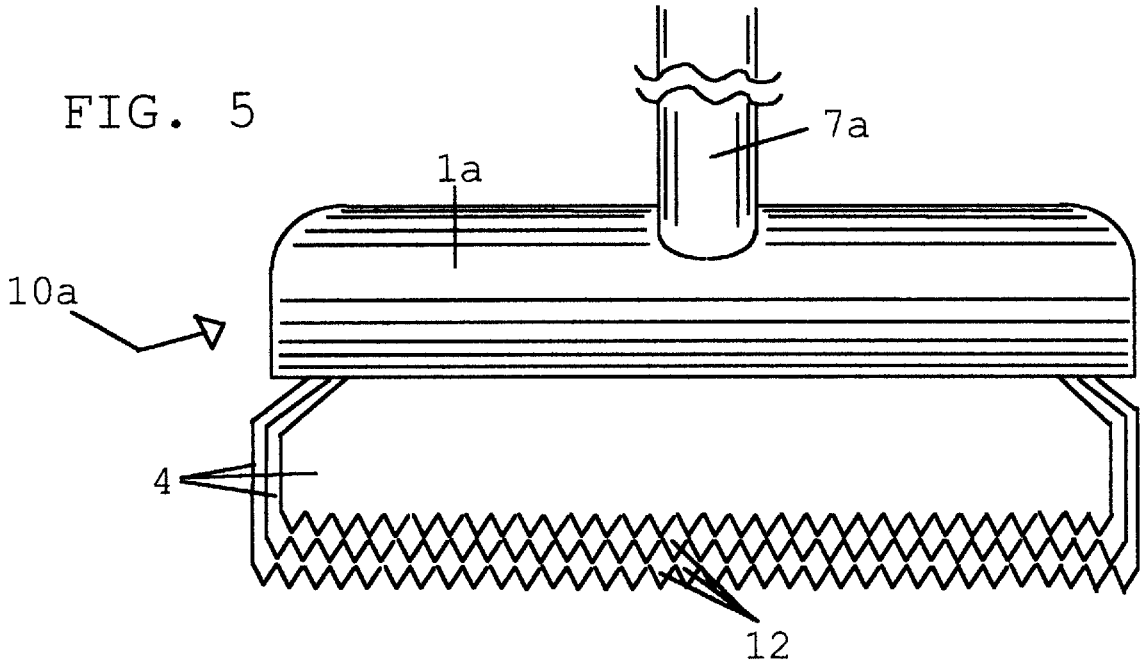
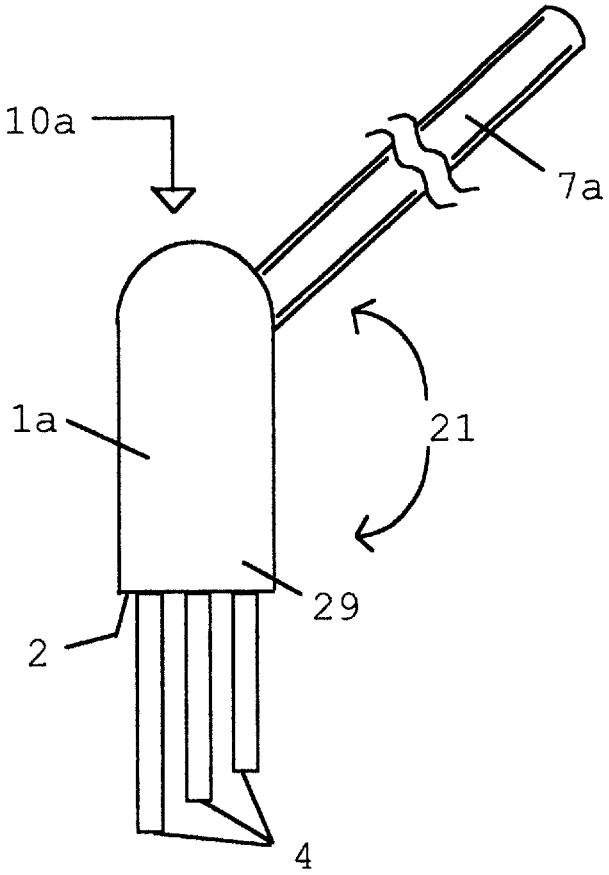
FIG. 6

COMB FOR REMOVING DEBRIS ON CARPET

BACKGROUND OF THE INVENTION

The invention relates to a tool used for combing over carpet pile. In particular, the tool is used for the collection of pine needles and other debris that lie on the surface or get embedded in carpet pile. The manual action of combing this tool over the carpet pile results in the collection of debris that is lying on the carpet or embedded in the carpet.

In the past various devices have been invented for the removal of certain objects form the carpet pile. U.S. Pat. No. 4,291,430 pertains to the removal of staples embedded in carpet. U.S. Pat. No. 4,042,995 pertains to the removal of animal hair from carpet. U.S. Pat. No. 5,533,223 pertains to the removal of debris from carpet through the use of an adhesive. U.S. Pat. No. 4,156,298 pertains to a shag rug fluffing and object retrieving device in which magnetism is used. Numerous inventions pertain to the cleaning of carpets through means of liquids, steam, foam, or granules. There are also inventions that are used to restore carpet and to ready for additional cleaning such as U.S. Pat. No. 3,999,244 "Shag Rug Rake", and U.S. Pat. No. 4,107,808 "Device for preparing the cleaning of carpet floors". None of these previously mentioned patents are of the same design as the present invention. U.S. Pat. Nos. 8,547,25 and 6,023,811 are similar in design, but the plates of each are such that they are adjacent and in direct contact with one another. The present invention has plates that are spaced so that debris can be collected between the plates as well as in front of the plates. U.S. Pat. No. 5,533,00 and foreign paten 804859 are also similar in design, but the plates of each are such that they do not vary in height like the present invention. The height variation of the plates is such that the tool can be maneuvered along the carpet at an angle so that the plates with the accompanying teeth are at spaced intervals along the carpet so that debris can be collected between the plates more easily and efficiently. None of the previously mentioned patents have plates with the teeth such that the teeth are purposely misaligned. This staggering of the plates with the teeth is necessary so that debris will not slip through all the plates and not get collected.

The pine needles and other debris that are left lying on the carpet or embedded in the carpet after the holiday season have posed a problem for those people who choose to have a live Christmas tree in their home for the holidays rather than an artificial tree. Some people purposely choose an artificial tree because of the mess and hassle of having to clean up all the fallen needles and other debris that the trees leave behind. These dry and brittle needles get embedded in carpet and are difficult and time consuming to clean up.

Vacuum cleaners are often used to try and remove the needles from the carpeting. The results of using a vacuum cleaner are poor due to the adherence between the needles and the carpet. The same area must be swept over and over again to effect any sort of removal. The pine needles often get stuck in the carpeting, and vacuums don't usually provide enough suction to dislodge the needles. Assuming that the vacuum cleaner does remove some of the needles, the needles being dry, brittle, and for the most part inflexible, often get clogged in the vacuum. The nozzle, the ridged hose, and the housing between the hose and the tank become clogged easily with the dry pine needles. Removal of the clogged needles from the vacuum is a very time consuming tedious task.

Other methods of removing needles from the carpeting include hand picking. Hand picking of pine needles from carpeting can be an exhausting chore, and sometimes a painful one due to needles pricks. It can take hours to completely remove all of the needles that a single pine tree leaves behind.

This invention solves the problem of cleaning up the pine needles and other debris left on the carpet or embedded in the carpet after the Christmas tree is removed form the home. The invention is not limited to the removal of pine needles, but can be employed for the collection of other debris as well.

SUMMARY

A preferred embodiment of the invention consists of a body in conjunction with a handle, and a plurality of plates that are spaced and are of varying heights. In conjunction with the plates are a plurality of teeth that are disposed on the edges of each plate distal from the body and are in a saw-toothed configuration such that the teeth of one plate do not align with the teeth of any adjacent plate. It is constructed such that when the plurality of plates in conjunction with the plurality of teeth are pressed against the carpet and dawn towards an operator, debris will be collected at the front side of the tool. The collection of debris can then be moved to a dust pan for easy removal. The plates, in conjunction with the teeth, are positioned such that the debris will be dislodged form the carpet pile and collected at the front side of the tool without slipping through.

A novel result of the comb according to the present invention is achieved through a combination of the plurality of plates which are spaced and are of varying heights are the plurality of teeth which are preferably disposed in a saw tooth configuration and are preferably positioned so that the saw-tooth configuration of one plate does not align with the configuration of any adjacent plates.

The plates, body and handle of the tool are not limited to any one construction material. A variety of materials such as wood, plastic, and metal can be used interchangeably.

It is a purpose of this invention to provide a tool that will quickly and easily collect pine needles and other debris that is left lying on the carpet pile or embedded din the carpet for easy pick up and removal.

It is further purpose of this invention to provide a sturdy tool that is simple and inexpensive in design so that excessive costs are avoided.

It is a further purpose of this invention to provide a tool that is efficient in use and requires a minimum amount of effort and time.

It is a further purpose of this invention to provide a light weight tool that is not cumbersome to use.

It is a further purpose of this invention to provide a tool that is sturdy in construction dn manual in operation so as to avoid the need for part replacement and repairs that accompany many motorized devices.

It is further purpose of this invention to provide a tool that is not limited or restricted to any one construction material.

BRIEF DESCRIPTION OF THE DRAWINGS

FIG. 3 is a view of an operator using a modified version of the tool.

FIG. 4 is a side view of the invention showing the angle of the body and plates in relation to the carpet pile and debris.

FIG. 5 is a front view of a modified version of the invention.

FIG. 6 is a side view of the embodiment of FIG. 5.

DESCRIPTION OF THE INVENTION

Figure 1:
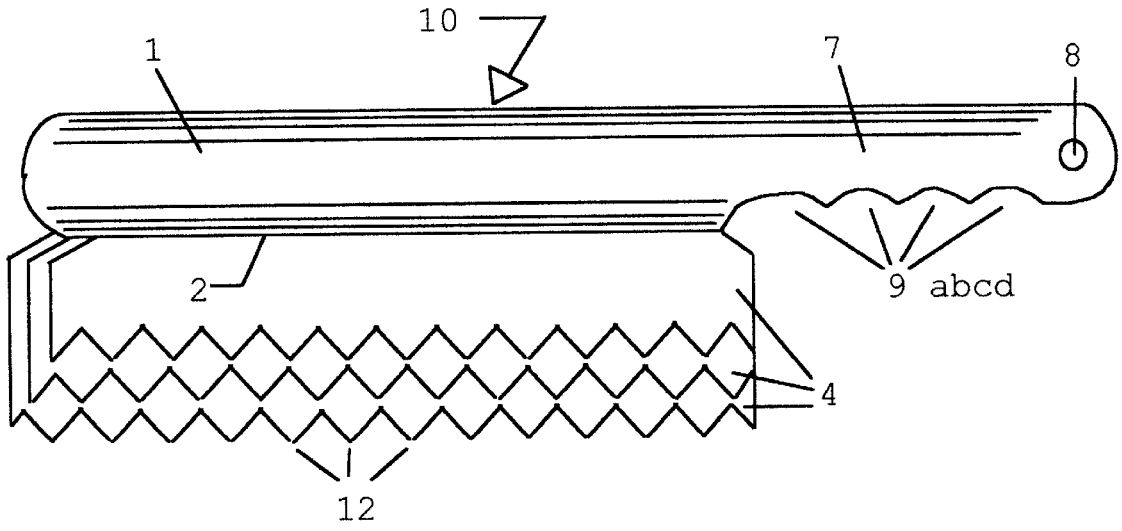
FIG. 1 is a front view showing the body, handle and the plurality of plates that extend downward from the body ending with a plurality of teeth that are in a saw-toothed configuration.

FIG. 1 illustrates on example of a cleaning tool in accordance with the present invention. This embodiment is referred to and identified by the reference numeral 10.

The embedment 10 as viewed from the front in FIG. 1 preferably comprises a rectangular body 1 having a handle 7 that is continuous with the body 1. The length and width of the body and handle are variable, but the longer the body, the greater the area of carpet that can be combed. The handle 7 is an extension of the body 1 that tapers to a size that fits comfortably in a average sized hand. The handle 7 has four finger indentations 9(*a, b, c, d*) for ease of gripping and holding. The handle 7 can be equipped with a hold drilled in the far end 8 to which a cord can be attached for hanging when not in use. Various materials can be used of right construction of the invention, such as wood, metal, or plastic.

Attached to the underside 2 of the body 1 is a plurality of plates 4. Each plate is permanently secured in grooves that have been cut in the body (not illustrated). The plates are preferably constructed of smooth, flat, sturdy material such as stainless steel or polymeric plastic. The plates 4 preferably extend at least the full length of the body 1. For ease of combing the carpet near walls and in corners, the plates 4 preferably extend past the length of the body 1 so that the body does not impede the combing action near walls and corners. The plates 4 extend downward from the underside of the body 2. Each plate 4 has a plurality of teeth 12 at the distal end of the plate furtherest from the body. The teeth 12 are preferably in a saw-toothed configuration. Each plate is preferably arranged so that the teeth in that plate are not aligned with the teeth in any adjacent plates. The plates 4 are preferably configured so that the for most plate is of a height that is least of all plates. The height of the plates preferably increases gradually from the foremost plate to the most distal. Each individual plate can effectively tough the carpet and aid in the collection of debris when the height of the plates vary. Each plate is preferably spaced an even distance from all other plates so that debris can be collected between the plates as well as in front of the plates. The number of plates is preferably two or more to effect the efficiency of the debris collection.

The number of teeth per plate can vary. Several models have been constructed and proven to work having between three to eight teeth per inch. The width of each plate can vary. Again, models have been built and proven to work with widths that vary between one-thirty-second of an inch to one-eighth of an inch thickness. The number of teeth per inch on each plate and the thickness or width of each plate can be combined to incorporate numerous combinations of the two.

Figure 2:
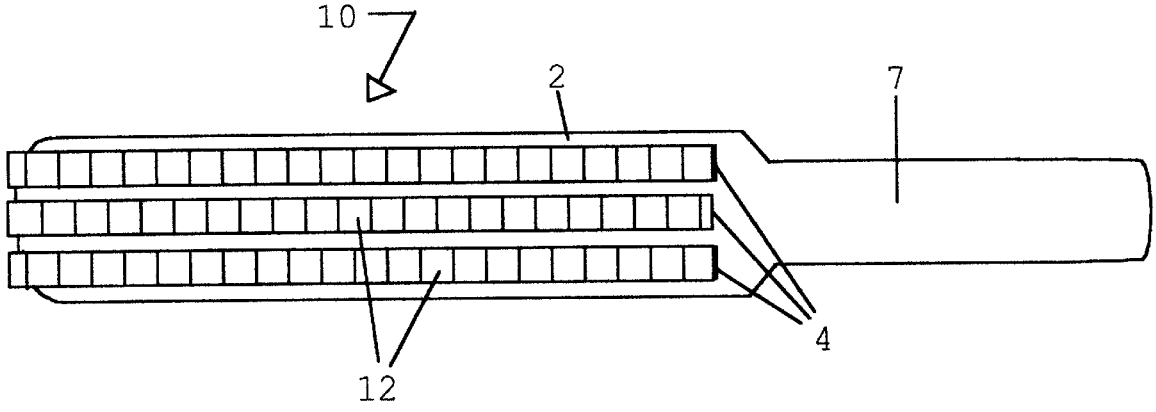
FIG. 2 is an underside view of the tool showing the positioning of the plates.

FIG. 2 shows the underside 2 of the embodiment 10. Portrayed in this view are the relative positions and spacing of the plates 4. Three plates are shown as one example; however, this invention is not limited to that specific number of plates. Also shown are the finger indentations 9(*a, b, c, d*) of the handle 7.

FIG. 3 depicts a modified version of the invention referenced as 10*a*. This modified embodiments 10*a* is for individuals who for one reason or another would rather not stoop down to use the original invention as seen in FIG. 1. An operator 30 is depicted using the modified embodiment 10*a*. The handle 7*a* has been elongated such as the handle of a broom, and is now preferably centered at the front side 29 of the modified body 1*a*. When the tool 10*a* is drawn towards the operator 30 as indicated by the arrow 27, the result is the collection of debris 19 from the carpet 18.

FIG. 4 depicts a side view of the invention in use. The angle 20 that is formed between the carpet 18 and the tool 10 is variable and depends on the lengths chosen for each individual plate in relationship with the other plates. The greater the height variation between individual plates, the smaller the angle will be. When the tool is pressed into the carpet 18 and is moved in the direction indicated by numeral 27 the debris 19 collects at the front side of the tool.

FIG. 5 depicts a modified version of the invention as depicted in FIG. 3. This modified embodiment 10*a* is for individuals who prefer not to stoop down to use the original embodiment 10 as seen in FIG. 1. A handle 7*a,* like the handle of a broom, is employed. The only difference that exists between the modified embodiment 10*a* and the original embodiment 10 is the body and the handle. The handle 7*a* is now located mid-way of the body 1*a,* and extends outwardly from the front side of the body 29. The handle 7*a* extends into the body 1*a* and is secured thereto.

FIG. 6 depicts a side view of the modified embodiments 10*a*. The preferred angle 21 that is made between the handle 7*a* and the front side of the body 29 is obtuse. The angle 21 varies in relationship to the height of each individual plate with relationship to the other plates.

This is to allow all plates to come in contact with the carpet at intervals so that maximum efficiency in the use of the tool is obtained.

Figure 7:
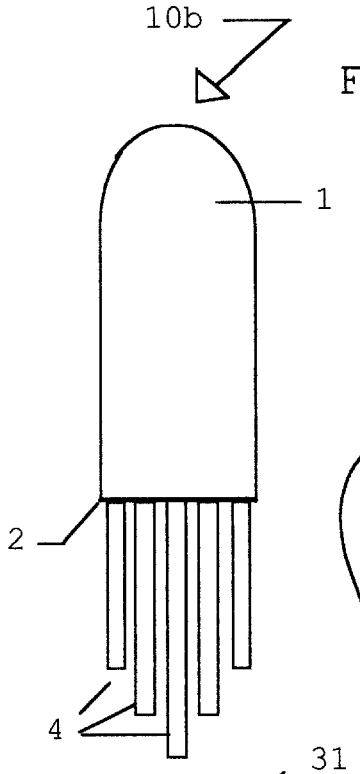
FIG. 7 is a side view of another modified version of the invention.

FIG. 7 depicts a side view of another version of the present invention referenced as numeral 10*b*. This embodiment differs from the original embodiment in that the plurality of plates 4 vary in height from a foremost plate 4*a* to a midway plate 4*m* to a most distal plate 4*z*. The height of the plates gradually increase until a midway plate 4*m* is reached. The height of each additional plate is then decreased gradually until the most distal plate 4*z* is reached. The gradual increase in height of the foremost plates are a mirror image of the gradual decrease of the height from the midway plate to the most distal. The plates are still spaced and are not in contact with each other. This embodiments allows the operator to move the tool in a to and fro motion with both motions efficiently collecting the debris in either direction as well s between the plates.

Figure 8:
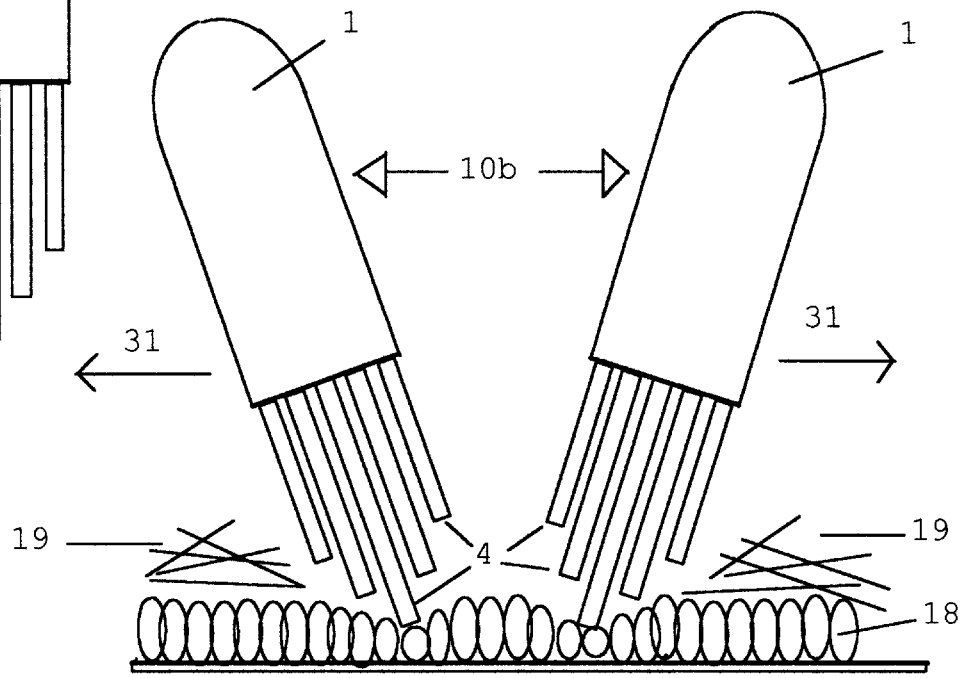
FIG. 8 is a side view of the embodiment of FIG. 7 showing the to and fro movement that can be employed with this particular embodiment.

FIG. 8 depicts a side view of the embodiments 10*b*. This embodiment can be drawn in a to and fro direction 31. Either direction 31 still allows for the efficient collection of debris 19 from the carpet 18.

What is claimed is:

1. A tool for the removal of pine needles and other debris disposed on a carpet comprising:

a) an elongated body which includes parallel grooves cuts into an underside of said body such that each said groove extends the entire length of said body such that said grooves are spaced and of equal distance apart, b) a handle that is continuous with said body such that said handle and said body is of a one-piece construction, c) a plurality of elongated plates extending into said grooves in said underside of said body such that a single plate is inserted into a respective groove and held therein, each said plate extends downward from said underside of said body wherein said plates extend at an unequal height such that a foremost plate has the least height and a most distal plate has the greatest height, said plates which extend from said underside of said body gradually increasing in height form said foremost plate to said most distal plate, d) a plurality of teeth disposed on an edge of each said plate wherein said teeth extend the entire length of each said plate and are arranged in a saw-toothed configuration, such that the saw-toothed configuration of teeth of one plate are not aligned with the saw-toothed configuration of teeth of an adjacent plate.

* * * * *